US006945176B2

(12) United States Patent
Säntti et al.

(10) Patent No.: US 6,945,176 B2
(45) Date of Patent: Sep. 20, 2005

(54) INTERCOMMUNICATING PASSAGEWAYS IN DOUBLE-DECKER RAILWAY COACHES

(75) Inventors: Kai Säntti, Oulu (FI); Jukka Koivurova, Oulu (FI)

(73) Assignee: Talgo Oy, Oulu (FI)

( * ) Notice: Subject to any disclaimer, the term of this patent is extended or adjusted under 35 U.S.C. 154(b) by 39 days.

(21) Appl. No.: 10/293,225

(22) Filed: Nov. 13, 2002

(65) Prior Publication Data

US 2003/0094116 A1 May 22, 2003

(30) Foreign Application Priority Data

Nov. 16, 2001 (FI) ..... 01660206

(51) Int. Cl.[7] ..... B61D 17/00
(52) U.S. Cl. ..... 105/3; 105/8.1
(58) Field of Search ..... 105/3, 1.5, 4.1, 105/8.1, 15, 18, 238.1, 340, 422; 296/176; 180/291, 312; 280/781

(56) References Cited

U.S. PATENT DOCUMENTS

| | | | | | |
|---|---|---|---|---|---|
| 2,843,417 | A | * | 7/1958 | Wahl et al. | 280/403 |
| 2,881,713 | A | * | 4/1959 | Brill et al. | 105/4.4 |
| 4,644,872 | A | * | 2/1987 | Vianello et al. | 105/8.1 |
| 4,860,665 | A | * | 8/1989 | Schmidt | 105/18 |
| 5,452,912 | A | * | 9/1995 | Boucquey | 280/403 |
| 5,644,989 | A | * | 7/1997 | Blanchier et al. | 105/340 |

FOREIGN PATENT DOCUMENTS

| | | | | |
|---|---|---|---|---|
| DE | 4335420 | | 4/1995 | |
| EP | 0336809 | | 10/1989 | |
| EP | 0 345 497 | A2 * | 12/1989 | |
| EP | 0642964 | | 3/1995 | |
| EP | 0756980 | | 2/1997 | |
| EP | 756980 | A1 * | 2/1997 | ..... B61D/1/00 |
| EP | 642964 | B1 * | 12/1997 | ..... B61D/1/00 |
| FR | 1 159 975 | | 4/1958 | |
| GB | 589565 | | 1/1945 | |
| GB | 1508173 | | 4/1978 | |

OTHER PUBLICATIONS

UIC Code 505–1 or Appendix 4, "Railway Transport Stock" "Rolling stock construction gauge", 8$^{th}$ edition Jan. 1, 1997.

* cited by examiner

*Primary Examiner*—Frantz F. Jules
(74) *Attorney, Agent, or Firm*—Hogan & Hartson, LLP

(57) ABSTRACT

An intercommunicating passageway (9) between double-decker articulated railway coaches (1) including a wheel frame (10) with a lowered center section (11) and a pair of wheels (12*a*, 12*b*) are at an area between two successive coaches, which have a lower passenger room (7) with a first floor (3) at a first lower level (H1*a*) between pairs of wheels, and an upper passenger room (8) with a second floor (4) at a higher level (H2), on top of said lower passenger room. In the passageway a first bridge (5) extends between two successive coaches, the first bridge being at a second lower level (H1*b*) on the first floors, and a second bridge (6) extends between the two successive coaches, the second bridge being substantially in the same higher level with the second floors of the coaches connected. The first and second lower levels (H1*a*, H1*b*) of the first floors and the first bridge are down from the highest peripheral point (P) of the wheels.

26 Claims, 3 Drawing Sheets

INTERCOMMUNICATING PASSAGEWAYS IN DOUBLE-DECKER RAILWAY COACHES

The invention relates to an intercommunicating passageway between double-decker articulated railway coaches, which have a limited kinematic gauge, and which comprise a lower passenger room with an inner height and a first floor at a lower level, and an upper passenger room with an inner height and a second floor at a higher level, on top of said lower passenger room.

Publication DE-43 35 420 concerns an intercommunicating, area for coaches with staircases for double decker rail vehicles, which is designed in such a way that persons moving rapidly into the upper decker by means of stairs quickly orientate themselves there and move comfortably to the seats of the respective coaches. The publication describes disadvantages in the double decker rail vehicles relating to the intercommunicating area in the upper decker and the staircase so that for example there is the problem of an excessively narrow passage and staircase connection in the upper deck and the resulting waste of space in the coach. According to the publication these problems are solved by locating the stairs and corridors of the two coupled coaches in the end region of the coaches diagonally opposite one another, as a result of which an X-shaped arrangement is produced, whereupon these stairs and corridors continue from a single bridge extending from coach to coach therebetween at a somewhat lower level than the upper deckers of the coupled coaches. The combination of the functions of the exit areas from the stairs and the intercommunicating area between coaches at the coupling point of each body is said to permit a space-saving walk-trough area to be provided.

Publication EP-0 336 809 discloses a double-decker car-carrying railway wagon with a deformable elastic membrane in the intercommunicating passage between the wagons. The main subject of the publication is the construction and configuration of the bellows, by which a free transport of vehicles and passengers is tried to obtain. The publication also shows two continuous floors, which assure prolongation of wagon floors with the aid of an appropriate deformation, and which are so enclosed within the bellows, too. How this could be possible is not explained. These kind of wagons are intended for transport of cars trough the English Channel, for which purpose the outer dimensions of the wagons are much greater than those allowable for ordinary railway networks. These wide dimensions can be calculated starting from the rail width, which is 1400 mm between the inner sides of the rails, whereupon the height of the wagon shown in the publication is approximately 6060 mm measured from the top surface of the rails, and the width thereof is approximately 4730 mm. In addition the form of the wagon, in cross-section at their upper corner areas, further deviates outwards from the loading/kinematic gauge allowable for ordinary railway networks. The lower floor of the wagon continues as a single plane between the universally used two axle bogies with four wheels and above these two axle bogies, which is not possible in wagons and coaches having standard kinematic gauge or profile according to UIC Code 505-1 OR Appendix 4, which defines a maximum height of 4660 mm or 4310 mm, because under these circumstances the room between the upper side of the two axle bogie and the upper limit of the gauge does not allow acceptable heights for two floors or decks. I.e. on top of the two axle bogies the limited vertical space compels to a design, in which there is only one deck in the area of bogies, and the lower floor is positioned downwards from the upper side of the bogie in the area between these bogies to provide the required headroom, just as disclosed in the above mentioned publication DE-43 35 420. The above said limitations are true also for all other kinematic gauges applicable for ordinary railways in Western and Eastern Europe and for most kinematic gauges applicable for ordinary railways in other continents.

The generally used prior art construction objected in DE-43 35 420 is shown in FIG. 6, from which the waste of room around the area of the door and the stair, and the waste of room on the two axle bogies are visible. It can be calculated that only about 40% of the total length of the coach can be provided with two decks with seats, and that about 20% of the total length of the wagon can be provided with one deck with seats. This means that the effective rate of coverage with seats in the ordinary coaches is approximately 40%+½·20%=50%. The effective rate of coverage with seats in the coach according to DE-43 35 420 is about 60%, which is so not much more than in the ordinary coaches.

Publications GB-589 565 and GB-1 508 173 disclose articulated railway vehicles, in which the wheels are so guided that they strike the track at a small negative angle on incidence thus enabling the train to be constructed of light weight material and run at high speed without danger of derailment. According to GB-589 565 this condition is attained by mounting a pair of wheels on a bogie or truck, which is disposed between two adjacent vehicles, and which is adapted to be locked to one or the other of said vehicles according to the direction of running. The wheels are mounted on the bogie independently of each other about a common axis line. The latter publication GB-1 508 173 describes improvements to the articulated railway vehicles having a car body, one end of which is supported by a running gear frame or bogie frame or yoke provided with the pair of wheels. The car body is further supported on springs bearing upon the running gear frame and located independently from one another symmetrically on each side of the central vertical longitudinal plane of the car. The springs are adjustable pneumatic springs in order to reduce the passenger awareness of unbalanced centrifugal force, only when the train reaches a speed above a predetermined minimum, and only when the track has a sufficient predetermined degree of curvature. Both of these publications are so directed to the construction and function of the wheel arrangement only.

Publication EP-0 642 964 discloses a double-decker articulated train consisting of articulatedly connected head and intermediate units, single-axle bogeys at the articulation joints, entrances at the intermediate units and passages at the articulation joints as well as of operationally couplable and uncouplable double-decker intermediate units and double-decker head units and with single-axle bogeys each at one end of each intermediate unit and movable hinge couplings at the articulation joints. So, there is a traditional axle between the two wheels in a bogey. The publication does not shown any suspensions or springs. The passages at the articulation joints between the double-decker units are constructed to be double-decked each in the form of a separate passage in each of the lower deck and the upper deck and the double-decker units comprise a circumferentially closed gangway bellows aligned with the external outline of the double-decker unit at one end and a collar, which receives the gangway bellows, in an end face frame surface at the other end. The hinge couplings at the articulation joints are movable in three axes, and have such a construction that it receives both the horizontal and vertical forces including transversal forces and supporting forces. An attempt to place lacking suspensions in the construction shows that the passage height would be substantially shallower than that disclosed in figures of the publication. The design is such that extremely great forces and moments are present in the bogey and the articulation, and accordingly a very heavy construction is needed.

The main object of the invention is to further improve the effective rate of coverage with seats in the railway coaches used in ordinary railway networks. This means that the passenger coach has an outer profile in accordance to UIC Code 505-1 OR Appendix 4 in Europe, or an outer profile in accordance to other respective national or international Codes or Standards applicable for ordinary railways at least in railway networks including railway network portions, which extend into cities, towns and the like, and that the coach should have as a many seats as possible. The second object of the invention is to enable such constructional features in the coach that the train can run without functional problems at high speeds. The third object of the invention is to enable said improvement with as simple and reliable a construction as possible, and to avoid any excessive costs.

The problems described and the objects defined above can be achieved by a combination of: A wheel frame at an area between two successive coaches, and having a lowered center section and a pair of wheels supported by and connected trough separate bearings to said wheel frame; A passageway in which a first bridge extends between two successive coaches, the first bridge being substantially in the same lower level with the first floors of the coaches connected, a second bridge extends between said two successive coaches, the second bridge being substantially in the same higher level with the second floors of the coaches connected, and said lower level of the first floors and the first bridge is down from the highest peripheral point of said wheels.

Now it has been surprisingly noticed that a the necessity to lead the passengers via a single floor in the area of wheels and between the coaches can be avoided, and instead two bridges and walkins can be arranged between the coaches as extensions of the upper floor and the lower floor, and hereby the waste of space can be considerably decreased. The very advantage of this arrangement according to the invention is that in practice an effective rate of coverage with seats in the order of at least 80% to 90% can be easily reached. This means that the almost the whole length of the coaches are provided with two decks or floors full of seats. A further advantage is that both of the two walkins between the coaches have proper headroom.

The invention is now described in detail with reference made to the accompanying drawings.

Figure 1:
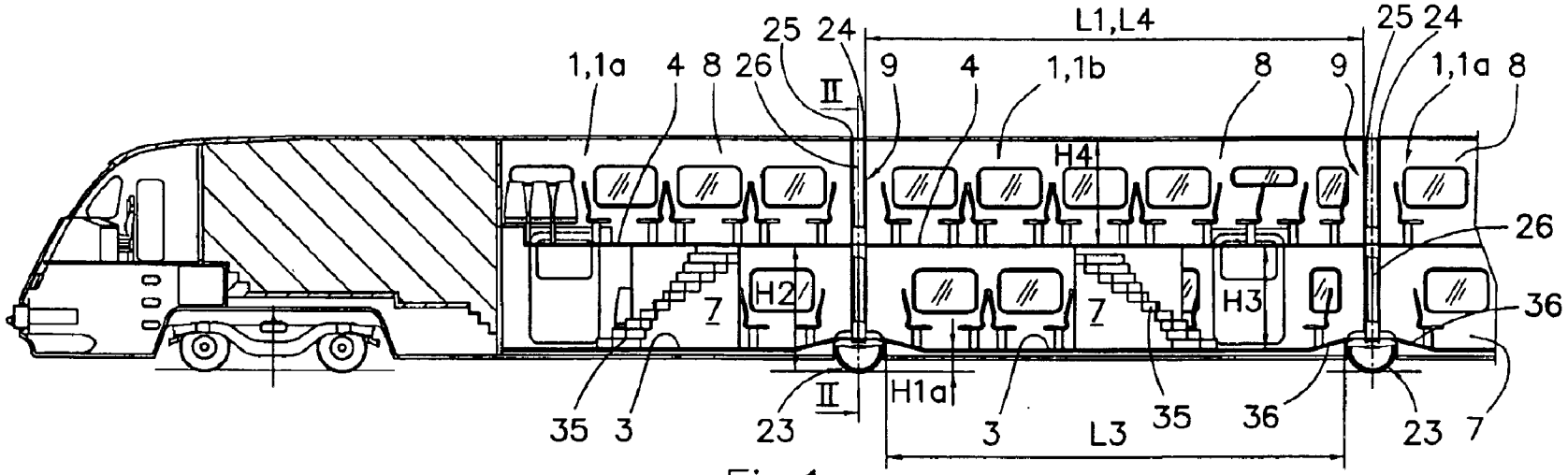
FIG. 1 illustrates generally a part of a train provided with the intercommunicating passageways between double-decker articulated railway coaches according to the invention, in a longitudinal section trough the vertical center plane I—I of FIG. 2.
Figure 6:
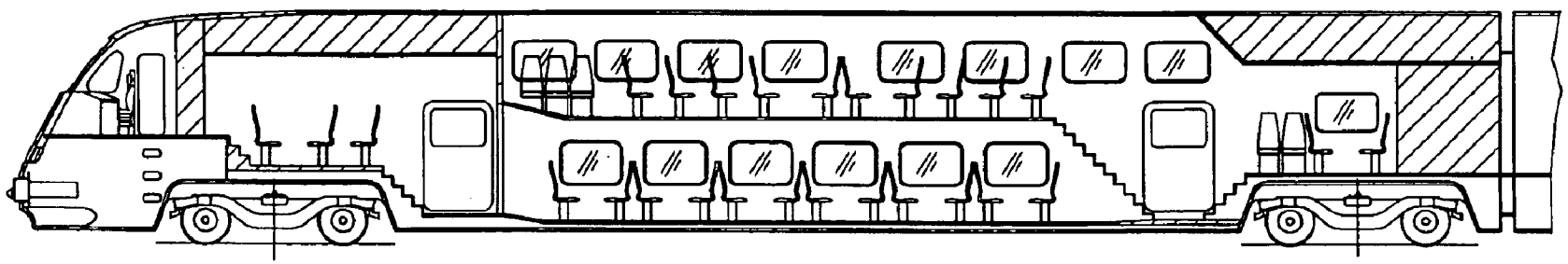
Prior Art Fig.6
FIG. 6 shows generally a part of a train according to Prior Art, in which each coach is provided with bogie units, each of which being two axle bogies at both ends of each coach, as well as a single floor in the area the intercommunicating passageway, in the same view as FIG. 1.

The intercommunicating passageway 9 between double-decker articulated railway coaches 1 according to the invention is a combination of several constructional features. The double-decker coaches 1 for passengers have a lower passenger room 7 and an upper passenger room 8 on top of the lower passenger room. The lower passenger room has an inner height H3 and a first floor 3 at a first lower level H1*a* with seats as shown in FIG. 1, and providing necessary vertical room for the passengers to walk along the coach as well as to and from their seats. The first floor 3 of the lower passenger room 7 is positioned between the pairs 23 of wheels 13*a*, I 3*b* at the ends 24, 25 of each of the coaches as described later, i.e. at a level, which is downward from the line going through the highest point of the wheels. Similarly the upper passenger room 8 has an inner height H4 and a second floor 4 at a higher level H2 with seats as shown in FIG. 1, and providing necessary vertical room for the passengers to walk along the coach as well as to and from their seats. The upper passenger room above the lower passenger room has a length L4 substantially equal with the length L1 of the coach 1 as practically do the length L3 of the lower passenger room, which assure a very high utilization of the total room inside the coaches. The length L3 of the lower passenger room is only slightly shorter than the total length L1 of the coach because of the suspension means 29, like a pair of springs for carrying the weight of the coaches, for the pair of wheels with their wheel frame 10 between the coaches, disclosed later in detail. Anyway the longitudinal room required by this one set of suspension means 29 included at least partially in the gap 26—which is always needed—between the adjacent ends 24, 25 of the successive coaches means very small loss of useful space in the lower passenger room and practically no loss of useful space in the upper passenger room. Of course there is needed staircases 35 between the upper passenger room 8 and the lower passenger room 7, but one bare staircase in a coach causes a decrease of a few seats only. When compared with the ordinary double-decker railway coaches, as shown in FIG. 6, it can be easily seen that the height portion between the upper limit of a standard kinematic gauge and the upper sides of the two axle bogies, which are arranged at both ends of each of the coaches, is so small that only a passenger room at one level above the bogies can be arranged in these areas. This causes a considerable loss of space, which together with the loss of space caused by staircases has a very negative impact on room utilization concerning ordinary coaches.

For the general railway networks the lateral dimensions of the coaches, and wagons as well, are strictly standardized and quite limited at least in the Europe Continent and more limited in Great Britain and also somewhat limited in USA concerning trains into and out of cities and the larger population centers. E.g. for Western Europe UIC Code 505-1 OR Appendix 4 is the standard typically obeyed. In the vertical direction, the kinematic gauge defined is so small that acceptable inner heights for two passenger rooms on top of each other are not available in the area of normal two axle bogies with wheels having large enough diameter for required load bearing capacity and high speed. That is why the lower floor typically extends between the wheels—regardless of the wheel arrangements—in a level, which is lower than the highest peripheral points of the wheels. Under these standard conditions the height portion Hp between the upper limit of a standard kinematic gauge and said wheels is smaller than the sum H3+H4 of the inner heights of two superimposed passenger rooms 7, 8, i.e. H3+H4≧Hp. Actually the headrooms—that is the spacing between the decks or floors should have been summed—but because the thickness of the floors and the roof in the coaches are very small as compared to the inner heights, these thicknesses can be neglected. The sum of this said height portion Hp and the rolling diameter Ø of the wheels shall be at maximum equal with the vertical kinematic gauge or smaller than the vertical kinematic gauge, i.e. Hp+Ø≦"kinematic gauge", whereupon the sum Hp+Ø of the height portion and the diameter is approaching the vertical kinematic gauge. The diameters Ø of the wheels 12*a*, 12*b* depends on the weights loading them and on the required speed of the train. Typically the wheel diameters Ø are at least 800 mm and preferably in the order of 900 mm to 950 mm. The inner height H3 of the lower passenger rooms 7 is substantially equal with the inner height H4 of the upper passenger rooms 8.

Figure 2:
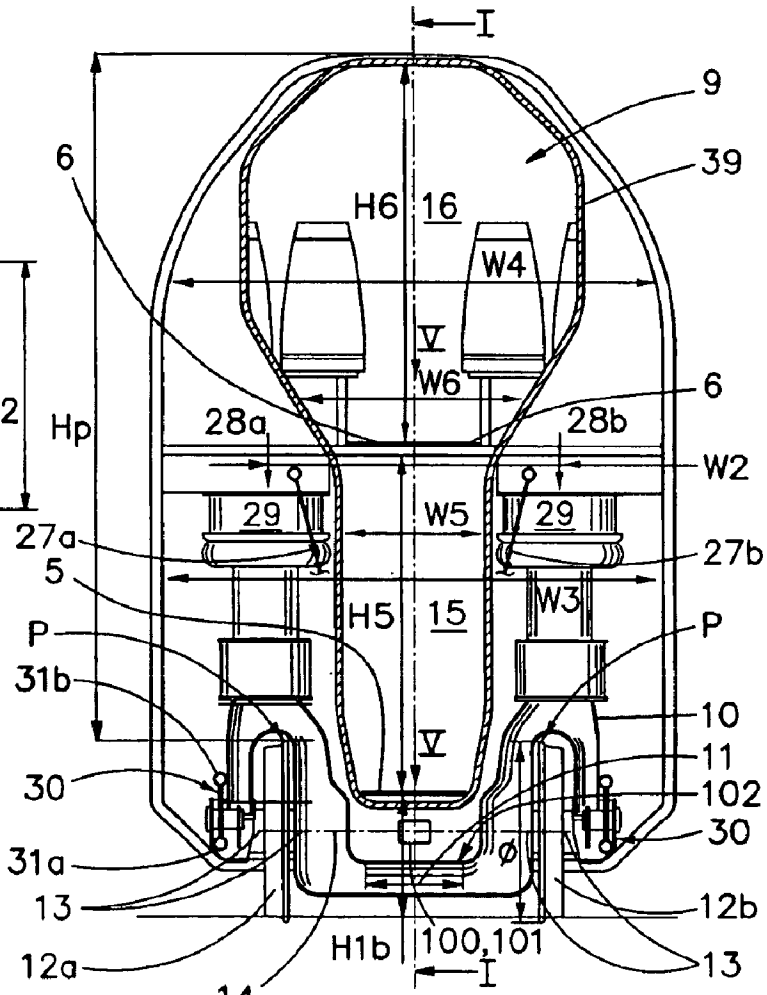
FIG. 2 illustrates an intercommunicating passageway according to the invention having a lower bridge and an upper bridge, as well as the wheel frame arrangement with a pair of independently rolling wheels between the successive coaches, partially in a transverse section trough the vertical plane II—II of FIG. 1 and partially in the respective direction.
Figure 3:
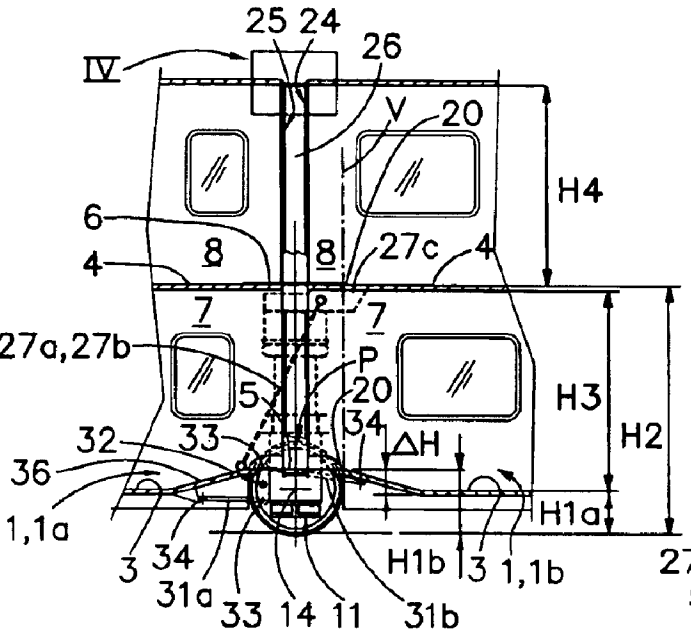
FIG. 3 illustrates an intercommunicating passageway of FIG. 1, and the wheel frame arrangement with a pair of independent wheels between the successive coaches, in the same view as in FIG. 2, but on a larger scale.
Figure 4:
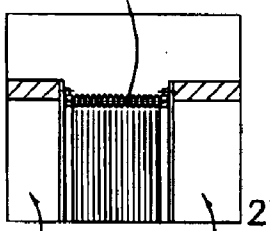
FIG. 4 illustrates a detail of the bellows comprised by and surrounding the intercommunicating passageway according to the invention from the area IV of FIG. 3.
Figure 5:
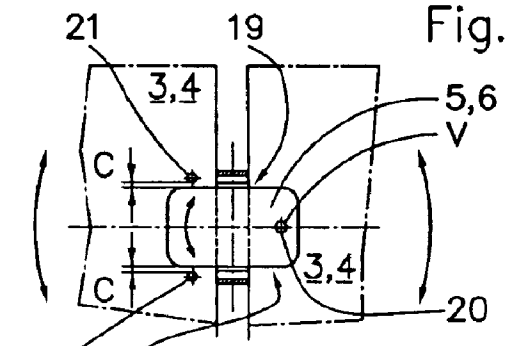
FIG. 5 illustrates diagrammatically the bridges at the lower and upper floor of the coaches extending from coach to coach within the intercommunicating passageway according to the invention in a plan view V of FIG. 2.
Figure 7:
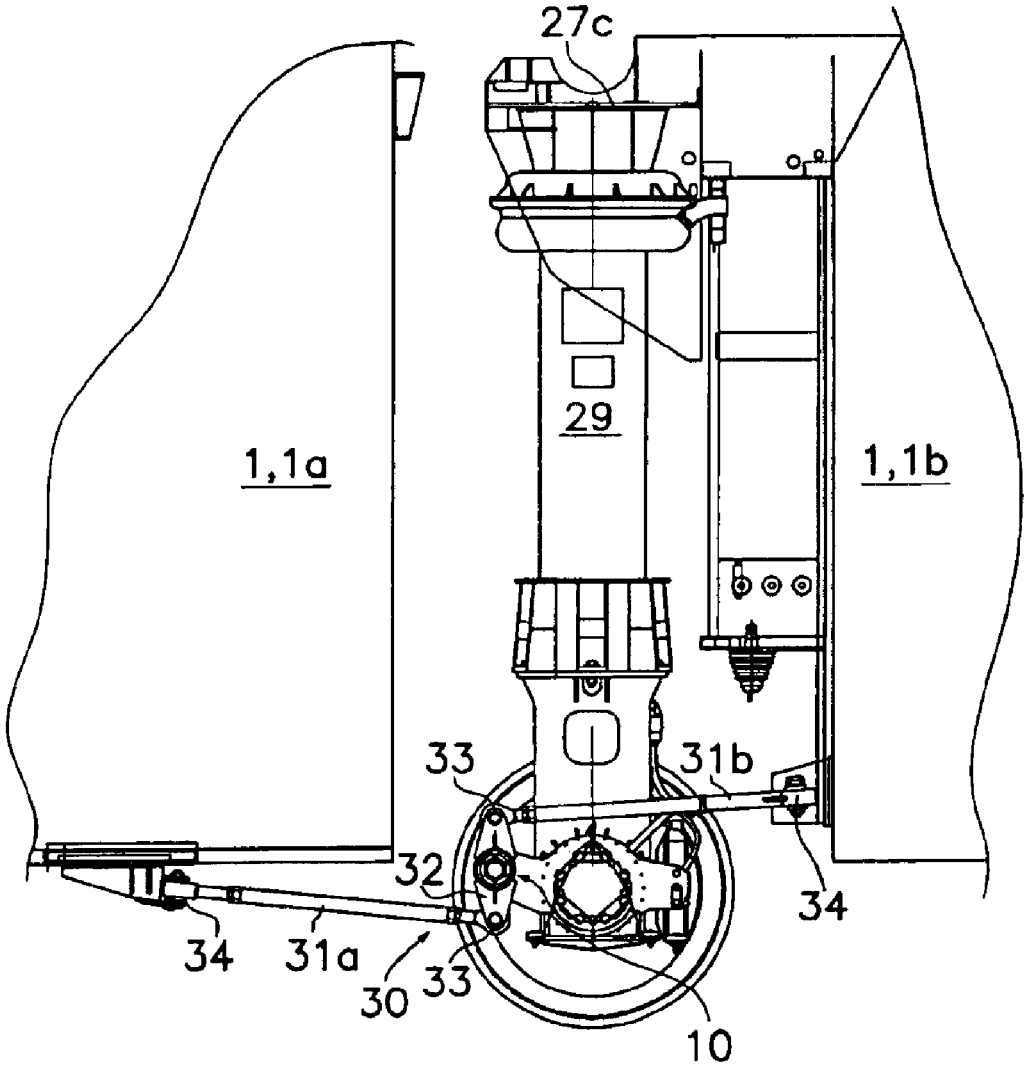
FIG. 7 illustrates an intercommunicating passageway of FIG. 1 in further detail, and in particular illustrates the pairs of connection rods and the control lever.

The adjacent ends 24, 25 of each of two successive coaches 1*a* and 1*b* or 1*b* and 1*a* are both supported by the wheel frame 10, which is positioned, with its wheels 13*a*, 13*b*, at the area—at least partly within the gap 26—between two successive coaches. The reference number 1 is used generally for the coaches, and the reference numbers 1*a*, 1*b* are used for occasions, in which the successive coaches shall be distinguished from each other, only. The gap 26 between the adjacent ends 24, 25 of the successive coaches are needed to provide room for turning the coaches in respect to each other along a curved passage of rails, i.e. to allow an angle deviating from 180° between the longitudinal axis of the successive coaches. The wheel frame has a lowered center section 11, which means that the wheel frame 10 has a form of the letter ∪ in the direction transversal to the length L1 of the coach, and a pair of wheels 12*a*, 12*b* supported by and connected trough separate bearings 13 to said wheel frame, as visible in the FIG. 2. These wheels 12*a*, 12*b* in the pair 23 of wheels have a common axle line 14, but not a common shaft. The upper surface 102 of the lowered section 11 of the wheel frame is in a lower lever than the axle line 14 of the wheels 12*a*, 12*b*, which can roll with different rotational velocities from each other, thanks to mounting with independent bearings. Accordingly, the lowered section is down from the axel line 14. The coaches further comprise suspension means 29 mounted between the wheel frame 10 and a coach body at two points 28*a*, 28*b* having a spacing W2 therebetween in transversal direction of the coach. The suspension means 29 are rigidly attached at these two points 28*a*. 28*b* to the body of one of the two successive coaches at the support area 27*c* close to the end thereof, and the end of the other of the two successive coaches is supported via a pair of carrying bars 27*a*, 27*b* at both longitudinal sides of the coaches, e.g. approximately in the vertical area of said support points 28*a*, 28*b* of the suspension means, and crossing the gap 26. The carrying bars 27*a*, 27*b* are attached to that coach with suspensions means at a point, which is at substantially higher lever than the attachment point in the other coach, which is supported by these carrying bars. So the load from both adjacent ends 24, 25 of two successive coaches are carried through the suspension means 29 and a single wheel frame 10 with the pair 23 of wheels. The successive coaches 1*a*, 1*b* further comprise two pairs 30 of connection rods 31*a*, 31*b* therebetween. The connection rods in both pairs 30, each at one longitudinal side of the coaches, being longitudinally successive and interposed by a control lever 32 through articulations 33. Each of the control levers 32 is pivotally secured to one of the transversally opposite end regions of the wheel frame 10, and the connection rods being coupled with stationary articulations 34 with the mutually opposite ends of the successive coaches. Connecting rods 31*a*, 31*b* and the control lever 32 across the gap 26 halves the mutual longitudinal movements on both sides of the train, on one side a shortening movement and on the other side a lengthening movement, for the wheel frame so creating the parallelism between the tangent of the rails and the rolling plane of the wheels. So, the two connection rods 31*a*, 31*b* with their control lever 32 forms a variable length connection between the subsequent coaches. The carrying bars 27*a*, 27*b* carry the vertical forces and partly the transversal forces between the coaches, and the connecting rods 31*a*, 31*b* with the control levers 32 provide the guidance for the pair of wheels so that the axle line 14 thereof is always perpendicular to the direction of the rails. The articulation construction further comprises, not shown in detail in the figures, two coupling rods 100 each extending from an end of the successive coaches towards each other and are connected through an articulation 101. The coupling rods 100 with their articulation 101 connects the successive coaches 1*a*, 1*b*, 1*a* etc. without any contact with the wheel frame. The vertical line trough the effective turning point of the articulation 101 and the horizontal axel line 14 are coincident, i.e. intersect each other. Typically the coupling rods 100 and the articulation 101 is positioned in the room left by the lowered center section 11, i.e. the coupling rods and the articulation extend from coach to coach above the lowered center section but below the first bridge 5, and preferably the coupling rods and the articulation may be approximately in the height of the axel line or lower than the axel line. This arrangement enhances avoiding any moment forces in the connection of the coaches. This articulation construction carries the longitudinal forces and part of the transversal forces, but not any part of the vertical forces present between the coaches. The further technical features of the articulated connection between each two successive coaches, i.e. the articulation construction, the constructional details of the control lever 32, the connecting rods 31*a*, 31*b*, the carrying bars 27*a*, 27*b* and the suspension means 29 are not described more in detail, because the invention is not dependent on these additional features.

In the passageway there is according to the invention a first bridge 5 extending between two successive coaches 1*a*, 1*b*, the first bridge being substantially at a second lower level H1*b* and on the first floors 3 of the coaches connected, and further a second bridge 6 extending between the two successive coaches 1*a*, 1*b*. The first lower level H1*a* of the first floors and second lower levels H1*b* of the first bridges are down from the highest peripheral point P of the wheels. In the embodiment of the invention shown in the figures, the second lower level H1*b* is at a slightly higher level than the first lower level H1*a*, there being a small height difference ΔH, whereupon the second lower level H1*b* of the first bridge 5 is positioned at a height, which is between the axle line 14 and the highest peripheral point P of the wheels. To attain a continuous floor level, preferably without stairs to enable easy going of passengers and especially going of disabled persons e.g. with their wheel chairs, the first floors 3 are provided with a ramps 36 at both ends of the coach rising from the first lower level H1*a* to the second lower level H1*b*. Depending on the configuration and dimensions of the wheel frame 10 between the wheels 13*a* and 13*b*, it is also possible to arrange the first bridge substantially at the same level as the first floor 3. In this embodiment both the second lower level H1*b* of the first bridge and the first lower level H1*a* of the first floors can be so low as approximately at the height of the axle line 14. Anyway the first lower level H1*a* of the first floors 3 and the second lower level H1*b* of the first bridges 5 are down from the highest peripheral point P of the wheels, and typically somewhere between the highest peripheral point P and the common axle line 14 of the wheels. So the first bridge 5 extends from coach to coach 1*b* to 1*a* to 1*b* etc. between the wheels 12*a* and 12*b* of the pair of wheels and above the lowered center section 11 of the wheel frame 10. The second bridge 6 is substantially at the same higher level H2 with the second floors 4 of the coaches connected. The first bridge 5 typically rests against the first floors 3 or against the ramps 36 thereof of the successive and adjacent coaches. In a similar way the second bridge 6 typically rest against second floors 4 of the successive and adjacent coaches. If only possible the second lower level H1*b* of the first bridge 5 should be closer to a common axle line 14 of said pair of wheels than the highest peripheral point P of the wheels.

Because of the second bridges 6 above the first bridges 5, which stay at a second lower level H1*b* being considerably lower than the highest peripheral point P of the wheels and approaching the first lower level of the first floors 3, the intercommunicating passageway has, according to the invention, a lower walkin 15 above or upwards from the first bridge 5, continuing from a lower passenger room 7 in one of the successive coaches 1*a* or 1*b* to a lower passenger room 7 in another of the successive coaches 1*b* or 1*a*. The lower walkin 15 extending from coach to coach along and within the spacing W2 between the mounting points 28*a*, 28*b* of the suspension means to the coach. This lower walkin 15 has an inner height H5 substantially the same as, or approaching that H3 of the lower passenger rooms. The possible difference between the inner height H5 of the lower walkin and the inner height H3 of the lower passenger room 7 is the height difference ΔH, which is a fraction of the inner height H3 of the lower passenger room. The height difference ΔH is smaller than 20%, preferably smaller than 15%, and typically from 5% to 10% of the inner height H3 of the lower passenger room. The intercommunicating passageway has, according to the invention, also an upper walkin 16 above the second bridge 6, continuing from an upper passenger room 8 in one of the successive coaches 1*a* or 1*b* to an upper passenger room 8 in another of the successive coaches 1*b* or 1*a*. This upper walkin has-an inner height H6 approaching that H4 of the upper passenger rooms. In most cases the inner height H6 of the upper walkin 16 is practically the same as the inner height H4 of the upper passenger rooms. The height variations in the order of bridge thicknesses shall be considered unessential, while the thickness of the bridges 5, 6 can be extremely small, like 10 mm 30 mm, because of the low loads caused by passengers and the shortness of the gap 26 between the coaches. The lower walkin 15 has an inner width W5, which is substantially smaller than inner width W3 of the lower passenger rooms 7, and the upper walkin 16 has an inner width W6, which is substantially smaller than inner width W4 of the upper passenger rooms 8. These smaller widths W5, W6 for the walkins are acceptable and practical, because they are wide enough for passengers to move, and enable use of simple and lightweight bridges 5, 6.

Concerning the construction and fastening the bridges, one of the successive coaches comprises a lock 20 fixed in the first floor 3 and attaching the first bridge 5 to the coach pivotally around a vertical line V and a lock 20 fixed in the second floor 4 and attaching second bridge 6 to the coach pivotally around a vertical line V. The locks 20 may be simple vertical pin construction close to one longitudinal end of the bridges configured to prohibit unintentional removing of the bridge and to allow pivotal movement of the bridge around the vertical line V, which goes trough the pin. The pivotal movement happens when the train goes along a curved rail passage. The another of the adjacent and successive coaches, not provided with the pivotal coupling, comprises a pair of side stops 21 fixed in the first floor 3, and a pair of side stops 21 fixed in the second floor 4, whereupon the side stops are located transversally at both sides of the first and the second bridge 5,6. There is typically a small clearance C between the stops and longitudinal sides 19 of the bridges to allow gliding of the sides of the bridges along the side stops 21 under guidance thereof, during turning of coaches when moving into, along and out of a curved rail passages. The side stops may also include configurations for attachment of the bridges to the respective coach 1, and prohibiting unintentional removing of the bridges. Because the both adjacent ends 24, 25 of the successive coaches are supported simultaneously by the suspension means 29 common to both of them, there exists extremely shallow vertical movements, if anything at all, between these nearly abutting ends 24 and 25 of the successive coaches 1*a* and 1*b* and 1*a* etc., enabling the simple attachment of the bridges to the coaches, preferably directly to the first and the second floors 3, 4 and/or their support elements of the successive coaches. As a consequence the bridges 5, 6 are hardly noticeable by the passengers in the moving train.

The coaches further comprise bellows means 39 surrounding the passageway. The bellows means 39 are positioned substantially inwards from the kinematic gauge applied, and so the bellows means 39 goes along the predetermined limit line or area of the combination of the upper walkin 16 and the lower walkin 15, as clearly shown in FIG. 2. This arrangement ensures lower noise in the walkins, promotes tidiness and maintains the passengers to experience the walkins as parts of the actual passenger rooms 7, 8. It is also possible to arrange separate bellows means for the upper and lower walkin respectively, instead of a single and common bellows means for both walkins.

What is claimed is:

1. An intercommunicating passageway between double-decker articulated railway coaches, comprising in combination:

A wheel frame at an area between two successive coaches, and having a lowered center section transverse to a length direction of the coaches, and a pair of wheels supported by and connected through separate bearings without a common shaft to said wheel frame, said wheels having a large rolling diameter for high speed and load bearing capacity, Said coaches having a lower passenger room with an inner height and a first floor at a first lower level between pairs of wheels at the ends of the coaches, an upper passenger room with an inner height and a second floor at a higher level, on top of said lower passenger room, and a height portion between the upper limit of a standard kinematic gauge and said wheels smaller than the sum of said inner heights, In said passageway a first bridge extending between the two successive coaches, the first bridge being at a second lower level which is above the first floors of the coaches connected, a second bridge extending between said two successive coaches, the second bridge being substantially in the same higher level with the second floors of the coaches connected, and said first lower levels of the first floors and second lower levels of the first bridges are down from the highest peripheral point of said wheels.

2. The intercommunicating passageway according to claim 1, wherein said first lower levels of the first floors are substantially at a height of a common axle line of said pair of wheels.

3. The intercommunicating passageway according to claim 2, wherein said second lower levels of the first bridge are closer to a common axle line of said pair of wheels than the highest peripheral point of said wheels.

4. The intercommunicating passageway according to claim 1, further comprising a lower walkin above the first bridge, continuing from the lower passenger room in one of the successive coaches to a lower passenger room in another of the successive coaches, said lower walkin having an inner height approaching that of the lower passenger rooms.

5. The intercommunicating passageway according to claim 1, further comprising an upper walkin above the second bridge, continuing from an upper passenger room in one of the successive coaches to an upper passenger room in another of the successive coaches, said upper walkin having an inner height approaching that of the upper passenger rooms.

6. The intercommunicating passageway according to claims 4 or 5, wherein said upper walkin has an inner width and the lower walkin has an inner width, which are substantially smaller than inner width of the lower and the upper passenger rooms, respectively.

7. The intercommunicating passageway according to claim 1, wherein the inner height of the lower passenger rooms is substantially equal with the inner height of the upper passenger rooms.

8. The intercommunicating passageway according to claim 1, wherein said first bridge extends from coach to coach between the wheels of said pair of wheels and above the lowered center section of the wheel frame.

9. The intercommunicating passageway according to claim 1, wherein said successive coaches further comprise two pairs of connection rods therebetween, said connection rods in both pairs being longitudinally successive and interposed through articulations by a control lever pivotally secured to one of transversally opposite end regions of the wheel frame, and said connection rods being coupled with stationary articulations with the mutually opposite ends of the successive coaches.

10. The intercommunicating passageway according to claim 1, wherein one of the successive coaches comprises locks attaching said first and said second bridge to the coach pivotally around a vertical line.

11. The intercommunicating passageway according to claim 10, wherein another of the successive coaches comprises a pair of side stops fixed in said first floor and in said second floor, said side stops located transversally at both sides of the first and the second bridge.

12. The intercommunicating passageway according to claim 1, wherein said first bridge and said second bridge rest against the first floor and the second floor, respectively.

13. The intercommunicating passageway according to claim 1, wherein said coaches further comprise suspension means mounted between the wheel frame and a coach body at two points having a spacing therebetween in transversal direction of the coach, and a lower walkin extending from coach to coach along said spacing.

14. The intercommunicating passageway according to claim 13, wherein the other of the two successive,coaches is supported via at least a pair of carrying bars at both longitudinal sides of the coaches.

15. The intercommunicating passageway according to claim 1, wherein said coaches further comprise at least one bellows means surrounding the passageway; and that the bellows means are positioned substantially inwards from the kinematic gauge applied.

16. The intercommunicating passageway according to claim 1, wherein said lowered section is down from said common axle line.

17. The intercommunicating passageway according to claim 1, wherein said successive coaches further comprise coupling rods with an articulation connecting said coaches without contact with the wheel frame.

18. An intercommunicating passageway between double-decker articulated railway coaches, comprising in combination:

A wheel frame at an area between two successive coaches, and having a pair of wheels with a common axle line but not a common shaft supported by and connected through separate bearings to said wheel frame, and a lowered center section, which is down from said common axle line;

Said coaches having a lower passenger room with an inner height and a first floor at a first lower level between pairs of wheels at the ends of the coaches, an upper passenger room with an inner height and a second floor at a higher level, on top of said lower passenger room, In said passageway a first bridge extending between two successive coaches, the first bridge being at a second lower level which is above the first floors of the coaches connected, a second bridge extending between said two successive coaches, the second bridge being substantially in the same higher level with the second floors of the coaches connected, and said first lower levels of the first floors and second lower levels of the first bridges are down from the highest peripheral point of said wheels.

19. The intercommunicating passageway according to claim 18, further comprising a lower walkin above the first bridge, continuing from the lower passenger room in one of the successive coaches to a lower passenger room in another of the successive coaches, said lower walkin having an inner height approaching that of the lower passenger rooms.

20. The intercommunicating passageway according to claim 18, further comprising an upper walkin above the second bridge, continuing from an upper passenger room in one of the successive coaches to an upper passenger room in another of the successive coaches, said upper walkin having an inner height approaching that of the upper passenger rooms.

21. The intercommunicating passageway according to claim 18, wherein said first bridge extends from coach to coach between the wheels of said pair of wheels and above the lowered center section of the wheel frame.

22. The intercommunicating passageway according to claim 18, wherein one of the successive coaches comprises locks attaching said first and said second bridge to the coach pivotally around a vertical line.

23. The intercommunicating passageway according to claim 18, wherein said successive coaches further comprise two pairs of connection rods therebetween, said connection rods in both pairs being longitudinally successive and interposed through articulations by a control lever pivotally secured to one of transversally opposite end regions of the wheel frame, and said connection rods being coupled with stationary articulations with the mutually opposite ends of the successive coaches.

24. The intercommunicating passageway according to claim 18, wherein said successive coaches further comprise coupling rods with an articulation means connecting said coaches without contact with the wheel frame.

25. The intercommunicating passageway according to claim 18, wherein said coaches further comprise suspension means mounted between the wheel frame and a coach body at two points having a spacing therebetween in transversal direction of the coach, and a lower walkin extending from coach to coach along said spacing.

26. The intercommunicating passageway according to claim 25, wherein the other of the two successive coaches is supported via at least a pair of carrying bars at both longitudinal sides of the coaches.

* * * * *